United States Patent [19]

Chemello et al.

[11] Patent Number: 4,835,886

[45] Date of Patent: Jun. 6, 1989

[54] APPARATUS FOR WEDGING THE HEEL OF THE FOOT OF A SKIER IN A SKI BOOT

[75] Inventors: Jean-Pierre Chemello, Annecy-le-Vieux; Michel Mabboux, Seynod, both of France

[73] Assignee: Salomon S.A., Annecy Cedex, France

[21] Appl. No.: 133,349

[22] Filed: Dec. 15, 1987

[30] Foreign Application Priority Data

Dec. 17, 1986 [FR] France ..... 86 18302

[51] Int. Cl.[4] ..... A43B 5/04; A43B 7/14; A43B 19/00

[52] U.S. Cl. ..... 36/119; 36/71; 36/93

[58] Field of Search ..... 36/117–121, 36/88, 91, 93, 92, 71

[56] References Cited

U.S. PATENT DOCUMENTS

| | | | |
|---|---|---|---|
| 2,531,763 | 11/1950 | Andre . | |
| 3,855,716 | 12/1974 | Hutchinson | 36/119 |
| 3,945,135 | 3/1976 | Hanson et al. . | |
| 4,733,484 | 3/1988 | Delery | 36/120 |

FOREIGN PATENT DOCUMENTS

| | | | |
|---|---|---|---|
| 0056774 | 7/1982 | European Pat. Off. | 36/117 |
| 0158574 | 10/1985 | European Pat. Off. . | |
| 3527135 | 1/1987 | Fed. Rep. of Germany | 36/119 |
| 1006263 | 1/1952 | France . | |
| 1055295 | 2/1954 | France . | |
| 2180315 | 11/1973 | France . | |
| 2334315 | 7/1977 | France . | |
| 2342039 | 9/1977 | France . | |
| 2405665 | 5/1979 | France . | |
| 1069934 | 5/1976 | Italy . | |
| 365972 | 1/1963 | Switzerland . | |
| 626793 | 12/1981 | Switzerland . | |
| 654467 | 2/1986 | Switzerland | 36/119 |

*Primary Examiner*—James Kee Chi

*Attorney, Agent, or Firm*—Sandler & Greenblum

[57] ABSTRACT

Apparatus is provided for wedging the heel of the foot of a skier in a ski boot. A rear portion of the upper of a ski boot is provided with a support element which includes at least one wedge which is adapted to selectively cooperate with a portion of the element. At least one opening or recess is provided along one surface of the support element; the recess is adapted to receive the wedge, and a plate covers at least a part of the recess. The wedge is generally U-shaped and has arms of different thicknesses with a spacing such that each of the arms is adapted to be positioned on a different side of the plate.

23 Claims, 3 Drawing Sheets

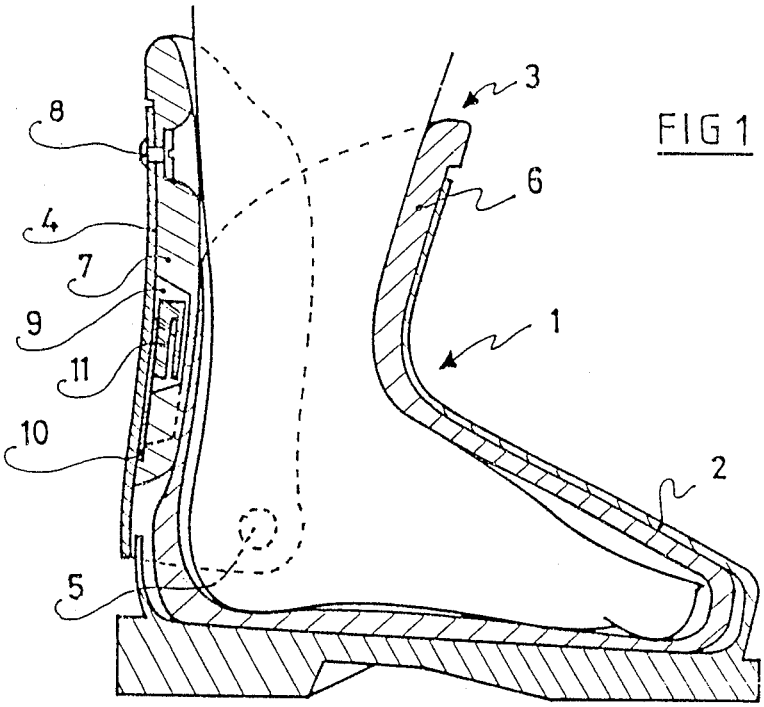
FIG 1
FIG 2
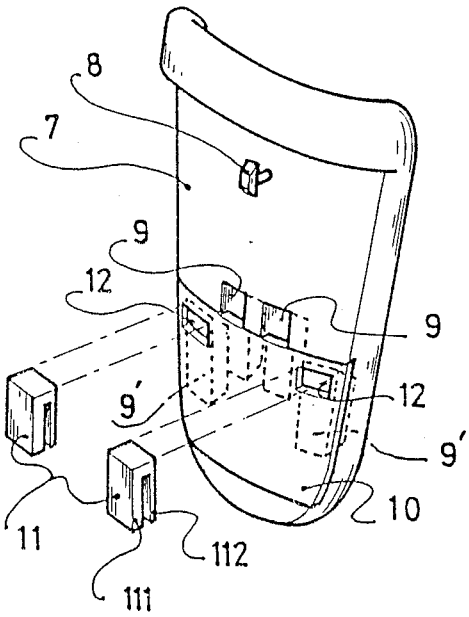
FIG 2 a
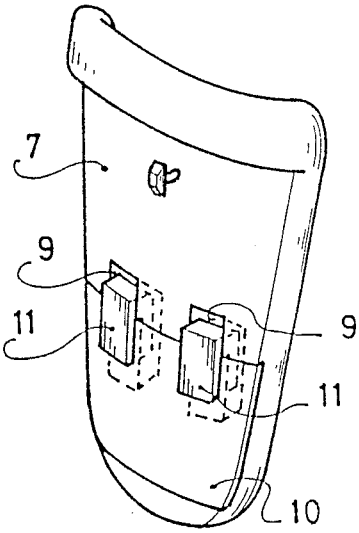

APPARATUS FOR WEDGING THE HEEL OF THE FOOT OF A SKIER IN A SKI BOOT

BACKGROUND OF THE DISCLOSURE

1. Technical Field of the Invention

The present invention generally relates to boots used for alpine skiing, and more specifically relates to an apparatus for wedging the heel of the foot of a user or skier in such boot.

2. Description of Background Art and Relevant Information

Wedging of the heel, and, more generally, of the foot, of a skier in its entirety, is often achieved by using a thickened portion which is positioned and attached within the upper portion of the boot. Such thickened portions are generally produced as part of a conventional internal bootie or applied thereto by, e.g., gluing, sewing, heat-welding, or other means, as, for example, is the case in French Pat. No. 1,006,263, U.S. Pat. No. 2,531,763, or French Pat. No. 1,055,295. The use of such thickened portions does not, however, provide for adjustment in the position or thickness of the wedging structure as a function of the particular morphology of the foot of the wearer.

Holddown apparatus for the heels of skiers, which apparatus squeezes the heel from the rear upper portion of the heel towards the lower zone of the malleoli of the skier, have been proposed both in Swiss Pat. No. 365,972 and in French Pat. No. 2,180,315. In these devices, adjustment of the position or thickness of the thickened portion becomes possible by acting on a fastening structure for the boot, e.g., a buckle, tightener, or a pressurized air pocket. Such apparatus are extremely complex in construction.

In other boots, e.g., those described in French Pat. No. 2,342,039, Swiss Pat. No. 626,793, and Italian Pat. No. 1,069,934, wedges are provided in the form of removable thickened portions which are adapted to be used with an interior bootie by introducing the wedges into pockets provided for this purpose or by hooking the wedges onto self-gripping straps. Such apparatus, however, offer only a single possibility for (the amount and position of) wedging through the use of removable thickened portions which must be replaced by other thickened portions to obtain a different wedging result.

Other solutions to the problem of heel wedging have been proposed in, e.g., French Patent Application No. 2,334,315, French Pat. No. 2,405,665, and U.S. Pat. No. 3,945,135, all of which describe heel wedging apparatus which are adjustable by wedges which are movable in their wedging positions, and which are different from the devices previously explained insofar as they are fixed in place so that they will not be removable. Such apparatus, which can have their positions effectively adjusted, are extremely mechanically complex, and further require changes so that they can be adapted for use in the shell of the boot of a skier. These solutions, accordingly, are less than desireable in view of the increased price and cost, which is disproportional to the expected results from their use.

SUMMARY OF THE INVENTION

In a first aspect of the present invention, an apparatus is provided for wedging the heel of the foot of a skier in a ski boot. The ski boot includes an upper, the apparatus comprising at least one support having a thickened portion, and the support having at least one opening or recess in the thickened portion and at least one plate which at least partially covers the at least one opening. The apparatus further comprises at least one wedge adapted to be positioned within one of the recesses in the support. The wedge is substantially U-shaped and has two arms, the arms having different thicknesses and being spaced apart from each other by a predetermined distance, wherein the wedge can be selectively positioned over an upper edge of the plate.

The wedge is adapted to occupy three positions, a first position completely within one of the recesses, a second position in which a thicker one of the arms is positioned on the exterior of the plate and a thinner one of the arms is positioned within one of the recesses, and a third position in which the thinner of the arms is positioned on the exterior of the plate and the thicker of the arms is positioned within the recess.

The thickened support portion can include at least two recesses, the recesses being positioned on opposite sides of the Achilles tendon of a skier when the apparatus is positioned within a ski boot which is worn by a skier.

Each recess is large enough to receive one of the wedges in its entirety; and the thickened support is adapted to be attached to the rear portion of an upper of a ski boot by a fastening element. The thickened support portion can be, e.g., part of a bootie adapted to be positioned on the interior of a boot.

The plate can be a force distribution plate which comprises a relatively thin plate formed from a semi-rigid material which is elastically deformable; or the plate can be a force distribution plate which is adapted to completely cover at least one of the recesses. The distribution plate further comprises at least one slot which is adapted to receive one arm of one of the U-shaped wedges. Each of the slots is aligned with a respective one of the recesses in the thickened support portion.

In another aspect, the present invention provides a wedging apparatus which is capable of wedging the heel of the foot of a skier in a ski boot. The wedging apparatus comprises a support element, the support element being flexible and including at least one recess on one surface thereof. The support element further comprises a plate positioned on the one surface so as to cover at least a portion of at least one recess, and the apparatus also include at least one generally U-shaped wedge having two spaced arms, each U-shaped wedge being adapted to be selectively positioned within one recess.

The apparatus can be used in combination with a ski boot having an upper.

The ski boot can be a rear entry type which includes a rear spoiler forming part of the upper; and the support element is positioned between an interior surface of the rear spoiler and an exterior surface of an inner liner positioned within the ski boot.

Alternately, the ski boot is a front entry type having a support element which is attached to an inner surface of a front spoiler of the ski boot.

The ski boot includes at least one pivotable spoiler forming part of the upper, and the support element is attached to the spoiler of the ski boot by a fastening element. One surface of the support element includes at least two spaced apart recesses.

The spaced apart recesses are positioned in a generally symmetrical fashion about a central plane of the support element so that, when positioned in a ski boot about the lower leg of a skier, they will be positioned on opposite sides of the Achilles tendon of the skier.

The plate has at least one slot on an exterior surface thereof, wherein each of the slots is adapted to be aligned with a respective recess of the support element when the plate is attached to the support element.

The apparatus may comprise, e.g., two of the wedges, wherein each of the generally U-shaped wedges is adapted to be positioned on an upper edge of the plate so that the arms are positioned on opposite sides of the plate.

The plate has an upper edge and a lower edge, and each U-shaped wedge is adapted to be selectively positioned on the plate so that a base portion of the U-shaped wedge rests on the upper edge of the plate, and so that the arms straddle the plate. Each wedge has a thicker arm and a thinner arm.

Each U-shaped wedge has two arms of different thicknesses, wherein each of arms is adapted to occupy at least three different positions to alter the wedging capability of the apparatus, a first position in which the U-shaped wedge is positioned entirely within one recess on the one support element surface, thereby providing no additional wedging effect to that provided by the support element, a second position in which a thicker arm of the U-shaped wedge is positioned within the recess and a thinner arm of the wedge is positioned on the exterior surface of the plate, thereby providing an intermediate wedging effect, and a third position in which the thicker arm of the U-shaped wedging element is positioned on the exterior of the plate, and the thinner arm of each said U-shaped wedging element is positioned within the recess, thereby providing a maximum wedging effect.

The support element can be independent, or it can comprise an integral part of an interior bootie of a ski boot.

The plate is relatively thin and is elastically deformable, and the support element is sufficiently flexible so that it is adapted to conform to the morphology of the lower leg of a skier.

In still another aspect of the present invention, a wedging apparatus for wedging the leg or foot of a skier in a ski boot is provided. The apparatus comprises a flexible support element adapted to be inserted between a lower leg or foot of a skier and an inner surface of a ski boot; the support element has at least one recess therein. A plate is adapted to be attached to the support element so as to at least partially cover each said recess. At least one replaceable wedge is selectively insertable into the recess, the wedge being substantially U-shaped and having two arms of different thicknesses, each of the arms being selectively positionable on an exterior surface of the plate, with the other of the arms being positioned within the recess.

BRIEF DESCRIPTION OF THE DRAWINGS

The above and other objects, features and advantages of the present invention are achieved by the present invention as detailed hereinafter with respect to the accompanying drawings, in which like reference numerals represent similar parts throughout the several views, and wherein:

FIG. 1 is a longitudinal cross-sectional view of a rear entry type of ski boot equipped with a heel wedging apparatus formed in accordance with the present invention, the wedging apparatus being shown in its neutral or minimal wedging (i.e., tightening) position;

FIGS. 2 and 2*a*, respectively, are perspective views which illustrate the wedging apparatus itself, shown outside of the boot for clarity, in accordance with two separate embodiments of the present invention;

DESCRIPTION OF PREFERRED EMBODIMENTS

Figure 3:
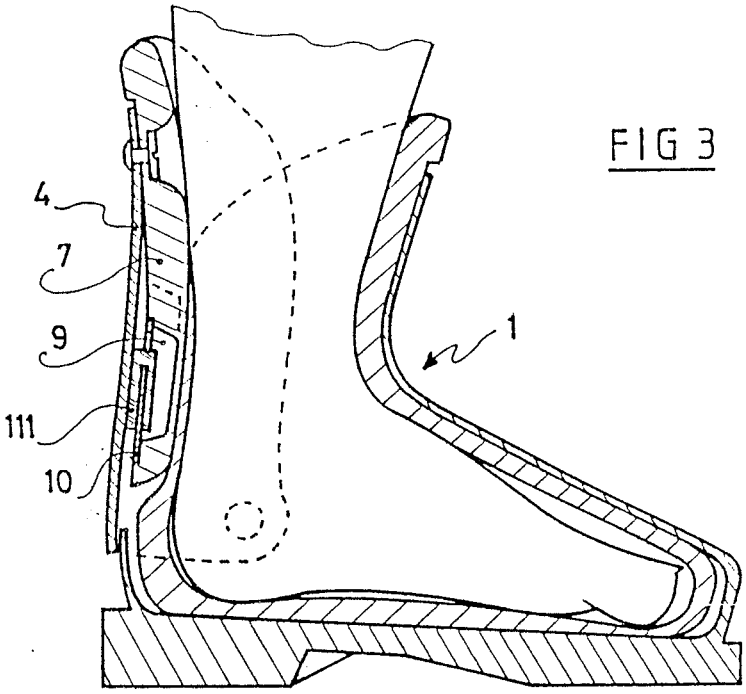
FIGS. 3 and 4 are both sectional views which illustrate the boot of FIG. 1 using wedging apparatus in accordance with the present invention in maximum and middle wedging positions, respectively.

The present invention provides a solution to the wedging problem which permits the use of a simple structure involving a wedging support having a thickened portion adapted to receive a wedge. The present invention provides the ability to adjust the wedging effect of the thickened portion by the substitution of one or more wedges for each other, and also provides for wedging adjustment by providing a plurality of adjustment positions for each individual wedge which can be positioned on the support structure. The latitude of adjustments obtained by thus moving the individual thickened wedge portion in a relatively fine manner provides for a desired degree of control in the position of the thickened wedge portion.

FIG. 1 illustrates, in longitudinal cross-section, a rear entry type of ski boot 1 having, in a conventional fashion, a shell base 2 upon which a rear spoiler 4 is journalled about a transverse axis 5. The rear spoiler forms a part of upper 3 of boot 1. As is conventional, an interior bootie or liner 6 can be positioned within the boot. The bootie or liner is not necessary to the present invention but adds to the comfort of the wearer.

A rear support element 7 is positioned between boot 6 and rear spoiler 4 and serves to support the lower leg of the wearer so as to ensure the wedging of the lower leg/foot of the user and, thus the heel of the user, above which the wedge is immediately positioned. The support element comprises, e.g., polyurethan foam. Support element 7 is preferably attached to the rear portion of upper 3, in a boot having a rear spoiler 4 as described above, via a binding element 8, e.g., via a screw or belt. Support element 7 comprises a curved portion which is both sufficiently flexible so as to guarantee the comfort of the wearer and sufficiently firm so as to assure a positive wedging effect for the heel of a skier within the boot. It preferably comprises an element which is completely distinct from the other portions of the boot but could be formed, dependent upon the precise construction, integrally as the rear or front portion of the bootie or liner 6 itself, either in whole or in part. The support element is considered as being distinct from bootie 6 and upper 3 of rear spoiler 4 in the following discussion, in accordance with the preferred construction; and different embodiments are illustrated in FIGS. 2 and 2*a*.

Support element 7, as shown, has a curved configuration which is adapted to the morphology of the lower leg/foot of a user, i.e., the portion of the leg which is located just above the heel. Each of the support elements comprises at least one opening or recess 9 extending over at least a portion of the thickness of the support element, with the openings being partially covered by a plate 10 for the purpose of distributing support stresses.

Distribution plate 10 is made from a semi-rigid material, e.g., prolyproxoyline and is adapted to support elastic deformation of the support element. This distribution plate can be, e.g., sewn, glued or fixed in any fashion onto support element 7. Preferably, at least two openings are provided in the support element, which openings are positioned on both sides of the Achilles tendon of the skier so as not to disturb the comfort of the wearer of the boot.

Individual wedges 11, each having a predetermined thickness, are positioned within each opening 9. Each of the wedges has a generally U-shaped configuration with two arms 111 and 112 (see FIG. 2) of different thicknesses. The spacing between the arms is selected with respect to the thickness of plate 10 so as to be able to overlap one edge of the plate in a U-fashion, as FIGS. 2 and 2*a* illustrate. In other words, one arm of the arms 111 and 112 is positioned in opening 9, and the other arm rests on the outside of the plate and thus further serves as a thickness wedge between support element 7 and rear portion 4 of upper 3. This is shown in both FIGS. 2 and 2*a*.

Figure 4:
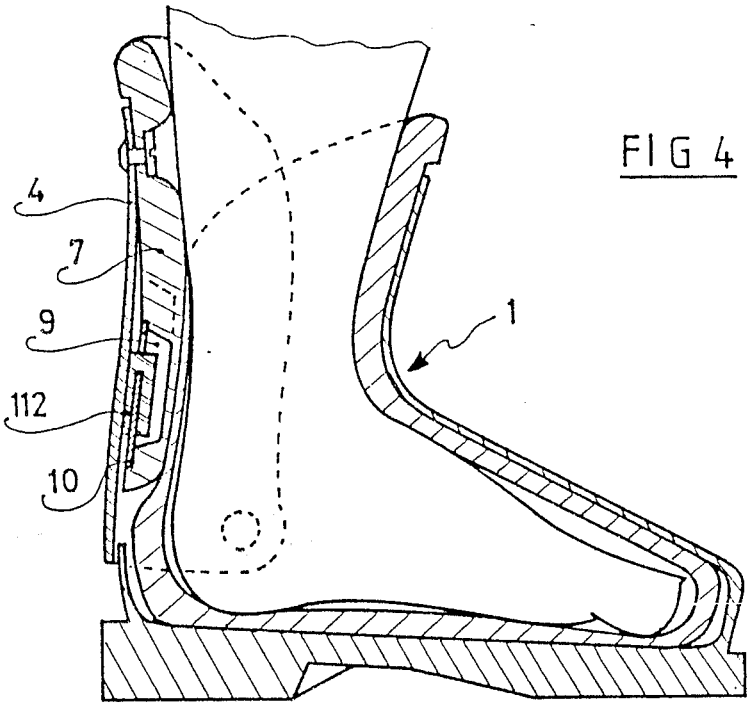

Each of the openings 9 is also configured so as to be able to receive wedges 11 in their entirety, as shown in FIG. 1. In this case, the wedges serve no purpose and are thus neutral with respect to the degree of wedging of the heel of the wearer which they provide. If, on the other hand, only one arm of each of the U-shaped wedges is positioned within opening 9, the base of the U-shaped wedge 11 will overlap the distribution plate 10 and will provide an increased thickness between the rear portion of upper 3, or its rear spoiler 4, which will change the degree of wedging of the foot within the boot. Effectively, when the rear spoiler is closed about the leg of the skier, the interior surface of spoiler 4 is supported on the one arm of the U-shaped wedge 11 which is located on the exterior surface of distribution plate 10. As a result, the distribution plate 10 transmits, substantially over its entire surface, the support force caused by the closure of the spoiler on support element 7, which is pressed downwardly and conforms itself to the morphology of the leg of the skier. Thus, as seen in FIG. 1, neutral wedging is provided, in which wedge 11 is totally positioned within a corresponding opening 9. In FIG. 3 a maximum wedging force is illustrated, in which the arm of greater thickness of the U-shaped wedge is positioned between the rear portion of upper 3 and support element 7. FIG. 4 illustrates a medium wedging effect, in which the smaller thickness arm of the U-shaped wedge 11 acts as a wedge with a thickness which is provided between support element 7 and upper 3. As a result, three different wedging possibilities for the heel are provided for a single set of wedges, i.e., neutral when the entire wedge is positioned in an aperture 9, medium when the thinner arm of wedge 11 is positioned exteriorly of distribution plate 10, and maximum when the thicker arm of the wedge is positioned exteriorly of the distribution plate 10. Accordingly, the apparatus formed as detailed herein is advantageous in that it provides a wedging structure with thickened portions, which portions are capable of remaining in the boot in different positions, including a neutral position. Thus, by using a single structure, and without the need to switch or replace wedges, a plurality of different wedging effects can be obtained.

It is also possible to provide, as shown, e.g., in FIG. 2, a larger number of openings 9 and 9', thus making it possible with a single set of wedges 11 to further vary the wedging of the heel by selecting the openings 9 and 9' which are to be used to receive the U-shaped wedges. Specifically, as illustrated in FIG. 2, distribution plate 10 will entirely cover openings 9', and the plate can include slots 12 which correspond in position, i.e., which are aligned, with openings 9' in order to permit the selective positioning of wedges 11 therein.

Thus, by selecting wedges of differing thicknesses on the two sides of the Achilles tendon of a skier, it is possible to alter the wedging effect exerted on these sides, and to thereby favor either the internal foot side or the external foot side with respect to the other, and with respect to the extent of relative wedging which is achieved by the wedges.

From the above, it should be clear that a system of removable wedges is provided which, although not permitting continuous adjustment, makes it possible to obtain, in an extremely simple manner, a plurality of degrees of wedging via discontinuous variation of the thicknesses of the wedges used such that there can either be no wedging, a maximum amount of wedging, or an intermediate amount of wedging; and that the amount and direction of the wedging force which is applied can be adjusted by selecting the positioning of openings 9 (and/or 9') of support element 7 in which wedges 11 are adapted to be positioned.

Figure 5:
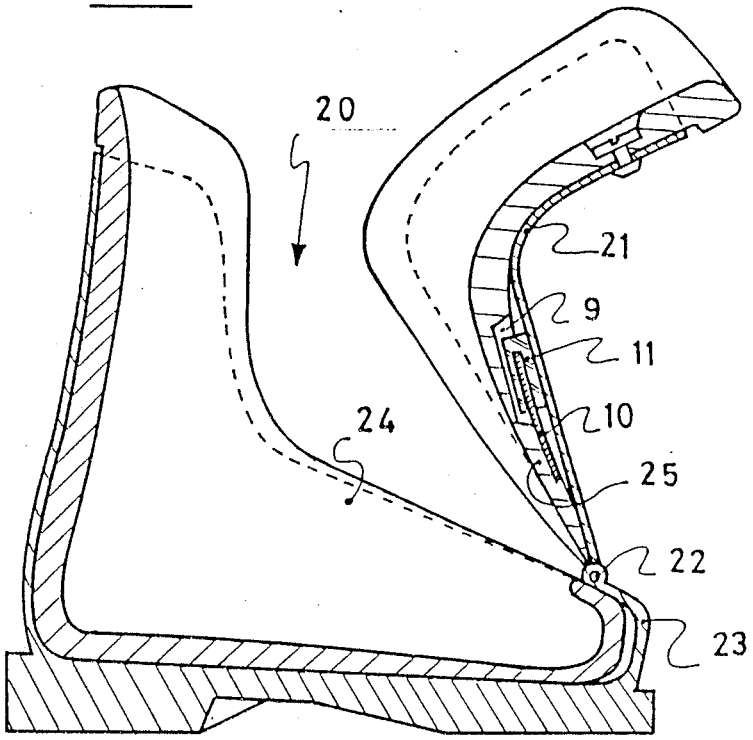
FIG. 5 is a sectional view of a wedging device in accordance with the present invention used at the front of a front entry type of ski boot.

Although the apparatus of the present invention has been described specifically with respect to a rear entry boot, it should be self-evident that the invention can also be provided on the front closure spoiler of a front entry boot without requiring further explanation, and that such a boot is clearly within the scope of the present invention. One such an embodiment of the present invention is illustrated in FIG. 5, in which a front entry type of ski boot 20 is schematically illustrated which comprises a front spoiler 21, e.g., a spoiler which is journalled along an axis 22 on a boot shell base 23 in which an interior bootie 24 is positioned, which spoiler opens forwardly. Front spoiler 21 comprises an attached wedging support element 25 which is adapted to completely cover, in a comfortable fashion, the front portion of the boot; and to envelope and tighten an area of the skier's leg which is located above the foot. To achieve these effects, support element 25 is provided with a wedging apparatus formed in accordance with the present invention. The wedging apparatus comprises, as previously described, a distribution plate 10 which at least partially covers one opening 9 provided in the thickness of support element 25, and a wedge 11 having a generally U-shape which is adapted to be positioned, dependent upon the needs of the skier, either completely in opening 9, or overlapping the upper edge of the wall of the distribution plate 10, so that it will provide an increased thickness between the support element and the wall of front spoiler 21, just as it did with the rear wall in FIGS. 1–5.

Although the present invention has been described with respect to specific structure, materials and embodiments, it should be understood to those of ordinary skill in the art that the present invention is not so limited to the particulars disclosed, and that it extends to all equivalents which can be considered to be within the scope of the claims.

What is claimed is:

1. An apparatus for wedging the heel of the foot of a skier in a ski boot, said ski boot having an upper, said apparatus comprising at least one support having a thickened portion, said support having at least one recess in said thickened portion and at least one plate which at least partially covers said at least one recess, said apparatus further comprising at least one wedge adapted to be positioned within said at least one recess in said support, said wedge being substantially U-shaped and having two arms, said arms having different thicknesses and being spaced apart from each other by a predetermined distance, wherein said wedge can be selectively positioned over an upper edge of said plate.

2. Apparatus in accordance with claim 1, wherein said wedge is adapted to occupy three positions, a first position in which it is completely positioned within one said recess, a second position in which a thicker one of said arms is positioned on the exterior of said plate and a thinner one of said arms is positioned within one said recess, and a third position in which the thinner one of said arms is positioned on the exterior of said plate and the thicker of said arms is positioned within said recess.

3. Apparatus in accordance with claim 1, wherein said thickened support portion includes at least two recesses, said recesses being positioned on opposite sides of the Achilles tendon of a skier when said apparatus is positioned within a ski boot which is worn by a skier.

4. Apparatus in accordance with claim 1, wherein each said recess is large enough to receive one said wedge in its entirety.

5. Apparatus in accordance with claim 1, wherein said thickened support portion is adapted to be attached to a rear portion of an upper of a ski boot by a fastening element.

6. Apparatus in accordance with claim 1, wherein said thickened support portion is part of a bootie adapted to be positioned on the interior of a ski boot.

7. Apparatus in accordance with claim 1, wherein said distribution plate is a force distribution plate comprising a relatively thin plate formed from a semi-rigid material which is elastically deformable.

8. Apparatus in accordance with claim 1, wherein said plate is a distribution plate which is adapted to completely cover at least one said recess, said distribution plate further comprising at least one slot which is adapted to receive an arm of one of said U-shaped wedges, each said slot being aligned with a respective one of said recesses in said support.

9. A wedging apparatus which is capable of wedging the heel of the foot of a skier in a ski boot, said wedging apparatus comprising a support element, said support element being flexible and including at least one recess on one surface thereof, said support element further comprising a plate positioned on said one surface so as to cover at least a portion of at least one recess, and at least one generally U-shaped wedge having two spaced arms, said at least one U-shaped wedge being adapted to be selectively positioned within said at least one recess.

10. A wedging apparatus in accordance with claim 9, in combination with a ski boot having an upper.

11. A wedging apparatus in accordance with claim 10, wherein said ski boot is a rear entry type having a rear spoiler forming part of said upper and said support element is positioned between an interior surface of said rear spoiler and an exterior surface of an inner liner positioned within said ski boot.

12. A wedging apparatus in accordance with claim 10 wherein said ski boot is a front entry type having a front spoiler and said support element is attached to an inner surface of said front spoiler.

13. A wedging apparatus in accordance with claim 10 wherein said ski boot includes at least one pivotable spoiler forming part of said upper, and said support element is attached to said spoiler of said ski boot by a fastening element.

14. A wedging apparatus in accordance with claim 9, wherein said one surface of said support element includes at least two spaced apart recesses.

15. A wedging apparatus in accordance with claim 14, wherein said spaced apart recesses are positioned in a generally symmetrical fashion about a central plane of said support element so that, when positioned in a ski boot about the lower leg of a skier, said recesses will be positioned on opposite sides of the Achilles tendon of the skier.

16. A wedging apparatus in accordance with claim 14, wherein said at least one wedge comprises two wedges, wherein each of said generally U-shaped wedges is adapted to be positioned on an upper edge of said plate so that said arms are positioned on opposite sides of said plate.

17. A wedging apparatus in accordance with claim 9, wherein said plate has at least one slot on an exterior surface thereof, wherein each said slot is adapted to be aligned with a respective recess of said recesses of said support element when said plate is attached to said support element.

18. A wedging apparatus in accordance with claim 9, wherein said plate has an upper edge and a lower edge, and wherein each said U-shaped wedge is adapted to be selectively positioned on said plate so that a base portion of said U-shaped wedge rests on said upper edge of said plate, and so that said arms straddle said plate.

19. A wedging apparatus in accordance with claim 9, wherein each wedge has a thicker arm and a thinner arm.

20. A wedging apparatus in accordance with claim 9, wherein each said U-shaped wedge has two arms of different thicknesses, wherein each of said arms is adapted to occupy at least three different positions to alter the wedging capability of said apparatus, a first position in which said U-shaped wedge is positioned entirely within one recess on said one support element surface, thereby providing no additional wedging effect to that provided by said support element, a second position in which a thicker arm of said U-shaped wedge is positioned within said recess and a thinner arm of said wedge is positioned on the exterior surface of said plate, thereby providing an intermediate wedging effect, and a third position in which said thicker arm of said U-shaped wedging element is positioned on the exterior of said plate, and the thinner arm of each said U-shaped wedging element is positioned within said recess, thereby providing a maximum wedging effect.

21. A wedging apparatus in accordance with claim 20, wherein said support element comprises an integral part of an interior bootie of a ski boot.

22. A wedging apparatus in accordance with claim 9, wherein said plate is relatively thin and is elastically deformable, and wherein said support element is sufficiently flexible so that it is adapted to conform to the morphology of the lower leg of a skier.

23. A wedging apparatus for wedging the lower leg and foot of a skier in a ski boot, said apparatus comprising:

(a) a flexible support element adapted to be inserted between a portion of the lower leg of a skier and an inner surface of a ski boot, said support element having at least one recess therein;

(b) a plate adapted to be attached to said support element so as to at least partially cover said at least one recess; and (c) at least one replaceable wedge which is selectively insertable into said recess, said wedge being substantially U-shaped and having two arms of different thicknesses, each of said arms being selectively positionable on an exterior surface of said plate with the other of said arms being positioned within said recess, wherein said wedge can be completely positioned within one of said recesses.

* * * * *